US006253048B1

(12) United States Patent
Kido et al.

(10) Patent No.: US 6,253,048 B1
(45) Date of Patent: Jun. 26, 2001

(54) CONTACT CHARGING DEVICE

(75) Inventors: Eiichi Kido, Yamatokoriyama; Hiroshi Ishii, Osaka, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/633,276

(22) Filed: Aug. 4, 2000

(30) Foreign Application Priority Data

Aug. 4, 1999 (JP) ..... 11-221155

(51) Int. Cl.[7] ..... G03G 15/02
(52) U.S. Cl. ..... 399/174; 361/225
(58) Field of Search ..... 399/174, 176, 399/168, 50; 361/221, 225; 430/902

(56) References Cited

U.S. PATENT DOCUMENTS 5,126,913 6/1992 Araya et al. ..... 361/225
5,136,335 8/1992 Takeda et al. ..... 399/286
5,426,488 * 6/1995 Hayakawa et al. ..... 399/174
5,666,606 * 9/1997 Okano et al. ..... 399/174

* cited by examiner

*Primary Examiner*—Sophia S. Chen

(57) ABSTRACT

When electrostatic capacity $C_f$ [F/m$^2$] per unit area of an elastic member when an ac voltage of an arbitrary frequency f [Hz] is applied is given by $C_f = C_{1k} \cdot (f/1000)^{-a}$, using electrostatic capacity $C_{1k}$ [F/m$^2$] per unit area when an ac voltage of 1 kHz is applied and using a rate of change a, electrostatic capacity C of a micro-region of an elastic member per unit area is substituted with $C_f$ per each frequency component which forms a voltage of a rectangular pulse equivalent to a voltage applied to a charge system. Then, the elastic member is made of such a material that the rate of change a falls within a range of $a \leqq -0.1544 \cdot \log(C_{1k}/C_0) + 0.0307$, and further, within a range of $a \leqq -0.146 \cdot \log(C_{1k}/C_0) - 0.0688$. Consequently, it is possible to provide a contact charging device which incorporates conditions for improving charge uniformity, which are obtained by taking frequency characteristics of the electrostatic capacity into consideration.

13 Claims, 10 Drawing Sheets

CONTACT CHARGING DEVICE

FIELD OF THE INVENTION

The present invention relates to a contact charging device used as a charger in electrophotographic image forming devices, and in particular to charging stability thereof.

BACKGROUND OF THE INVENTION

A charger is used for charging the surface of a photoconductor to a predetermined potential as an initial image forming process in electrophotographic image forming devices such as photocopiers, facsimiles and laser printers. Such a charger used in general is a contact charging device having a charging roller (e.g. a rubber roller) which contacts the surface of the photoconductor while applying a voltage to the photoconductor through the charging roller.

FIG. 8 shows a state of a process for charging the photoconductor by a roller-type contact charging device. As shown in FIG. 8, the contact charging device is made up of a charging roller 10 and a direct-current (dc) low voltage power source 2, the charging roller 10 having a core 10*a* of a cylindrical shape as a center and being covered with an elastic member (charging member) 10*b* which is made of conductive rubber, etc. of a hollow cylinder, and the charging roller 10 coming into contact with a photoreceptor drum 3 at a nip portion (contact portion). The photoreceptor drum 3 is made up of a photoconductor 3*b* formed over a drum body 3*a* which is made of metal of a hollow cylinder.

The dc low voltage power source 2 applies a dc voltage E between the core 10*a* of the charging roller 10 and the drum body 3*a* of the photoreceptor drum 3 which is grounded. Accordingly, an inner peripheral surface (hereinafter referred to as inner surface) of the elastic member 10*b* is set to have a negative potential, and an inner surface of the photoconductor 3*b* a ground potential. When the photoreceptor drum 3 is driven to rotate in a direction of arrow A, the charging roller 10 rotates about the central axis of the core, in a direction of arrow B, following the rotation of the photoreceptor drum 3. Therefore, the surface of the photoconductor 3*b* which is brought into contact with the surface of the elastic member 10*b* at the entrance of the nip portion is charged while passing the nip portion, thus inducing a potential change.

Referring to FIG. 8, a power source is the dc low voltage power source 2, and the surface of the photoconductor 3*b* is negatively charged by having the drum body 3*a* grounded while making the core 10*a* of the charging roller 10 to have a negative potential. Alternatively, the dc voltage is applied so that a core side of the charging roller is set to have a higher potential with respect to the drum body so as to make a charge potential of the photoconductor a positive polarity. Further alternatively, the power source is an alternating-current (ac) superimposed power source in which an ac component is superimposed on a dc component, and the ac superimposed power source applies a voltage which varies as a function of time.

As shown in FIG. 8, the elastic member 10*b* can be regarded as a set of micro-regions whose resistance and electrostatic capacity are equivalent to one another and which are generated by being divided by infinite numbers of division lines in a radial direction linking the inner surface (surface on the side of a rotational center) and the outer surface. Each micro-region is equivalently represented by a parallel circuit made up of resistance R per unit area and electrostatic capacity C per unit area, the resistance R being obtained by multiplying a resistance value measured between predetermined regions of the inner surface and the outer surface of the elastic member 10*b*, respectively, by an area measured on the side of the outer surface, the electrostatic capacity C being obtained by dividing the electrostatic capacity measured between the inner and outer surfaces, by an area of the outer surface. In addition, the photoconductor 3*b* can be regarded as a set of infinite numbers of micro-regions in which a spacing between the inner surface (surface on the side of the rotational center) and the outer surface is equivalently represented by electrostatic capacity $C_0$ per unit area.

FIG. 9 shows an equivalent circuit when the photoconductor 3*b* is charged by the contact at the nip portion between a surface of the micro-region of the elastic member 10*b* and a surface of the micro-region of the photoconductor 3*b*. In the foregoing arrangement of the contact charging device, a power voltage e(t) shown in FIG. 9 is equal to a dc voltage E. In this case, it is assumed that the charging roller 10 and the photoreceptor drum 3 are rotating at the same circumferential speed without slipping with each other at the nip portion.

The equivalent circuit shown in FIG. 9 is formed when the micro-region of the elastic member 10*b* and micro-region of the photoconductor 3*b* shown in FIG. 8 come into contact with each other upon reaching the entrance of the nip portion, and the dc voltage E is fed to the equivalent circuit, which starts charging the photoconductor 3*b*, i.e. charging the electrostatic capacity $C_0$. After that, as the micro-regions move toward an exit of the nip portion, a charge current flows into the electrostatic capacity $C_0$ in accordance with a time constant $C_0 \cdot R$ (C is small and negligible) which is determined by the resistance R of the elastic member 10*b* and the electrostatic capacity $C_0$ of the photoconductor 3*b*. This results in increase in a terminal voltage $e_c(t)$ of the electrostatic capacity $C_0$. The charge current from the elastic member 10*b* toward the photoconductor 3*b* is equivalent of injecting negative charge, and is maximum at the entrance of the nip portion, then, decreases toward the exit. Consequently, a potential distribution at the nip portion (surface of the photoconductor 3*b*) takes the form substantially as shown in FIG. 8. Here, $V_0$ is an initial potential on the surface of the photoconductor 3*b*.

The elastic member 10*b* is required to be of a characteristic which would cause the photoconductor 3*b* to be uniformly charged at the end. It is known that uniformity of charge over the photoconductor 3*b* can be improved by making the time constant sufficiently small by reducing the resistance R of the elastic member 10*b* with respect to a given photoconductor 3*b*.

However, adopting only the foregoing method that attempts to improve the charge uniformity by reducing the time constant at the time of charging the photoconductor 3*b* raises a problem. Namely, sufficient charge uniformity cannot be obtained due to restrictions on a setting range of the time constant, which are imposed by adapting to pinhole leakage of the photoconductor 3*b* or by a nip width which can be set.

Japanese Examined Patent Publication No. 92617/1995 (Tokukohei 7-92617 published on Oct. 9, 1995; corresponding to U.S. Pat. No. 5,126,913) discloses another method of obtaining a resistance value of a charging roller for performing uniform charging by means of a charge model of a photoconductor which employed resistance and electrostatic capacity of the photoconductor and the charging roller. In this charge model, however, the electrostatic capacity of the charging roller is used as a constant value. As discussed, since the elastic member 10*b* of the charging roller 10 and the photoconductor 3*b* rotate while keeping contact with each other, their contact face (nip portion) is renewed constantly. Therefore, the surface of each micro-region of the elastic member 10*b* supplies the micro-region of the photoconductor 3*b* with charge whenever it contacts the surface of the micro-region of the photoconductor 3*b*, which results in a potential change substantially as shown in FIG. 8. In addition, a current does not flow anywhere except at the nip portion during rotation, and therefore, it can be said that the surface of the micro-region of the elastic member 10*b* and the core thereof are at the equivalent potential except at the nip portion.

In this way, a charging operation for charging an arbitrary micro-region of the photoconductor 3*b* through the charging roller 10 is a repetition of intermittent application of a voltage, and a potential immediately before leaving the nip portion (time $t_0$) is the charge potential of the photoconductor. Therefore, as shown in FIG. 10 (top), the power voltage e(t) in the equivalent circuit of FIG. 9 rises during nip portion passing time $t_0$ and is equivalent to a rectangular pulse whose period is the rotation period T of the charging roller 10. Here, the terminal voltage $e_R(t)$ of each micro-region of the elastic member 10*b* becomes a waveform pulse shown in FIG. 10 (second from the top), charge current i(t) which flows from each micro-region of the elastic member 10*b* to the micro-region of the photoconductor 3*b* a waveform pulse shown in FIG. 10 (third from the top), and the terminal voltage $e_c(t)$ a waveform pulse shown in FIG. 10 (bottom).

More specifically, a voltage applied across a combined region of the micro-region of the elastic member 10*b* and the micro-region of the photoconductor 3*b* which is in contact therewith has a frequency component (ac component). Consequently, the electrostatic capacity C of the elastic member 10*b* varies depending on a frequency. The frequency component varies depending on various conditions such as a roller diameter of the charging roller 10 and the nip width. Thus, in the foregoing method disclosed in the above publication which does not take into account frequency characteristics of the electrostatic capacity C, charge uniformity is not yet sufficiently improved because the resistance value of the charging roller 10 is not optimized.

SUMMARY OF THE INVENTION

It is an object of the present invention to provide a contact charging device having conditions for improving charge uniformity which are obtained by taking frequency characteristics of electrostatic capacity into consideration.

In order to attain the foregoing object, the contact charging device according to the present invention includes:

- a charging member for charging a surface of a photoconductor to a predetermined potential,
- the charging member being made of a material which satisfies a condition being set based on a charge potential of the photoconductor,
- the charge potential being obtained from electrostatic capacity of the charging member being a variable which varies in accordance with a frequency change of a voltage applied to the charging member.

In the foregoing structure, the surface of the photo conductor is charged to the predetermined potential by the contact between the charging member and the photoconductor.

Conventionally, for example, a resistance value of the charging member for performing uniform charging was obtained by a charge model of the photoconductor in which resistances and electrostatic capacities of the photoconductor and the charging member were employed. However, an optimum resistance value of the charging member could not be obtained in this charge model because the electrostatic capacity of the charging member was used as a constant value.

More specifically, since the charging member and the photoconductor actually rotate while keeping contact with each other and the photoconductor is supplied with charge whenever coming into contact with the charging member, a voltage across a combined region of the charging member and the photoconductor has a frequency component (ac component). Accordingly, the electrostatic capacity of the charging member is not constant, but varies depending on a frequency.

However, such frequency characteristics of the electrostatic capacity were not considered in the conventional charge model. Therefore, the resistance value of the charging member could not be optimized, and charge uniformity could not be improved sufficiently.

In contrast, in the foregoing structure of the present invention, the electrostatic capacity of the charging member is used as a variable which varies in accordance with frequency change of a voltage applied to the charging member to obtain a charge potential of the photoconductor, and the charging member is made of a material which satisfies a condition which is set based on the charge potential.

More specifically, in the present invention, by finding that the frequency characteristics of the electrostatic capacity of the charging member have a great influence over charge characteristics of the photoconductor, the frequency characteristics of the charging member are reflected in a condition for obtaining stable charging characteristics of the photoconductor. This makes it possible to select a material for the charging member with a more suitable condition than a conventional method in which such an influence of the frequency characteristics of the electrostatic capacity was not considered, thereby surely improving charge uniformity of the photoconductor.

Additional objects, features, and strengths of the present invention will be made clear by the description below. Further, the advantages of the present invention will be evident from the following explanation in reference to the drawings.

DESCRIPTION OF THE EMBODIMENTS

The following will explain one embodiment of the present invention with reference to FIGS. 1 through 7, 9 and 10.

Figure 1:
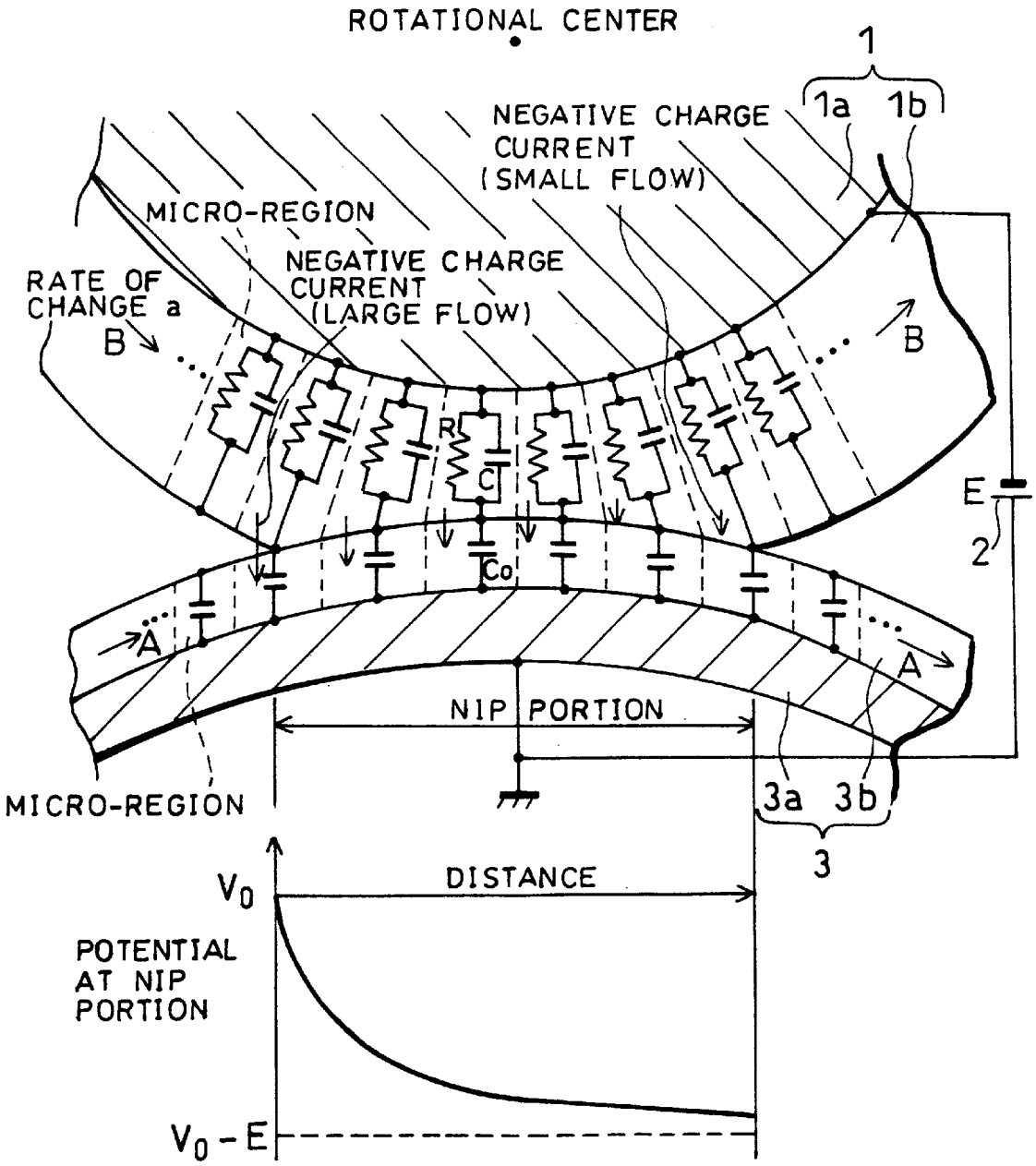
FIG. 1 is an explanatory drawing explaining a structure of a contact charging device according to one embodiment of the present invention and a charging operation therewith.

FIG. 1 shows a structure of a contact charging device of the present embodiment and a state of contact thereof with a photoreceptor drum 3. As shown in FIG. 1, the contact charging device is made up of a charging roller 1 and a dc low voltage power source (dc power source) 2, in which the center of the charging roller 1 is a core 1*a* of a cylindrical shape, and around the core 1*a* (its outer surface) is covered with an elastic member (charging member) 1*b* which is made of conductive rubber, etc. of a hollow cylinder, and the charging roller 1 contacts the photoreceptor drum 3 at a nip portion (contact portion). The feature of the present embodiment is that a material of the elastic member 1*b* is selected so that a rate of change a (discussed later; hereinafter referred to as change rate a) falls within a specific range. In addition, the photoreceptor drum 3 has an arrangement, as explained, in which a photoconductor 3*b* is formed over a drum body 3*a* which is made of metal of a hollow cylinder.

The dc low voltage power source 2 applies a dc voltage E between the core 1*a* of the charging roller 1 and the drum body 3*a*. Accordingly, an inner peripheral surface (inner surface) of the elastic member 1*b* is set to have a negative potential, and an inner surface of the photoconductor 3*b* a ground potential. When the photoreceptor drum 3 is driven to rotate in a direction of arrow A, the charging roller 1 rotates in a direction of arrow B, following the rotation of the photoreceptor drum 3. Therefore, the surface of the photoconductor 3*b* which comes into contact with the surface of the elastic member 1*b* at the entrance of the nip portion is charged while passing the nip portion, thus inducing a potential change as shown in FIG. 1. Here, $V_0$ is an initial potential of the photoconductor 3*b*.

As discussed, it is assumed in respect of the elastic member 1*b* that R [$\Omega m^2$] is a resistance per unit area, which is obtained by multiplying a resistance value measured between a predetermined region of the inner surface and that of the outer surface of the elastic member, by an area measured on the side of the outer surface, and C [$F/m^2$] is electrostatic capacity per unit area, which is obtained by dividing the electrostatic capacity measured between the inner and outer surfaces, by an area of the outer surface. Here, the elastic member 1*b* can be regarded as a set of infinite numbers of micro-regions equivalently represented by a parallel circuit made up of the resistance R and the electrostatic capacity C, while the photoconductor can be regarded as a set of infinite numbers of micro-regions equivalently represented by electrostatic capacity $C_0$ [$F/m^2$] per unit area between the inner and outer surfaces.

Figure 3:
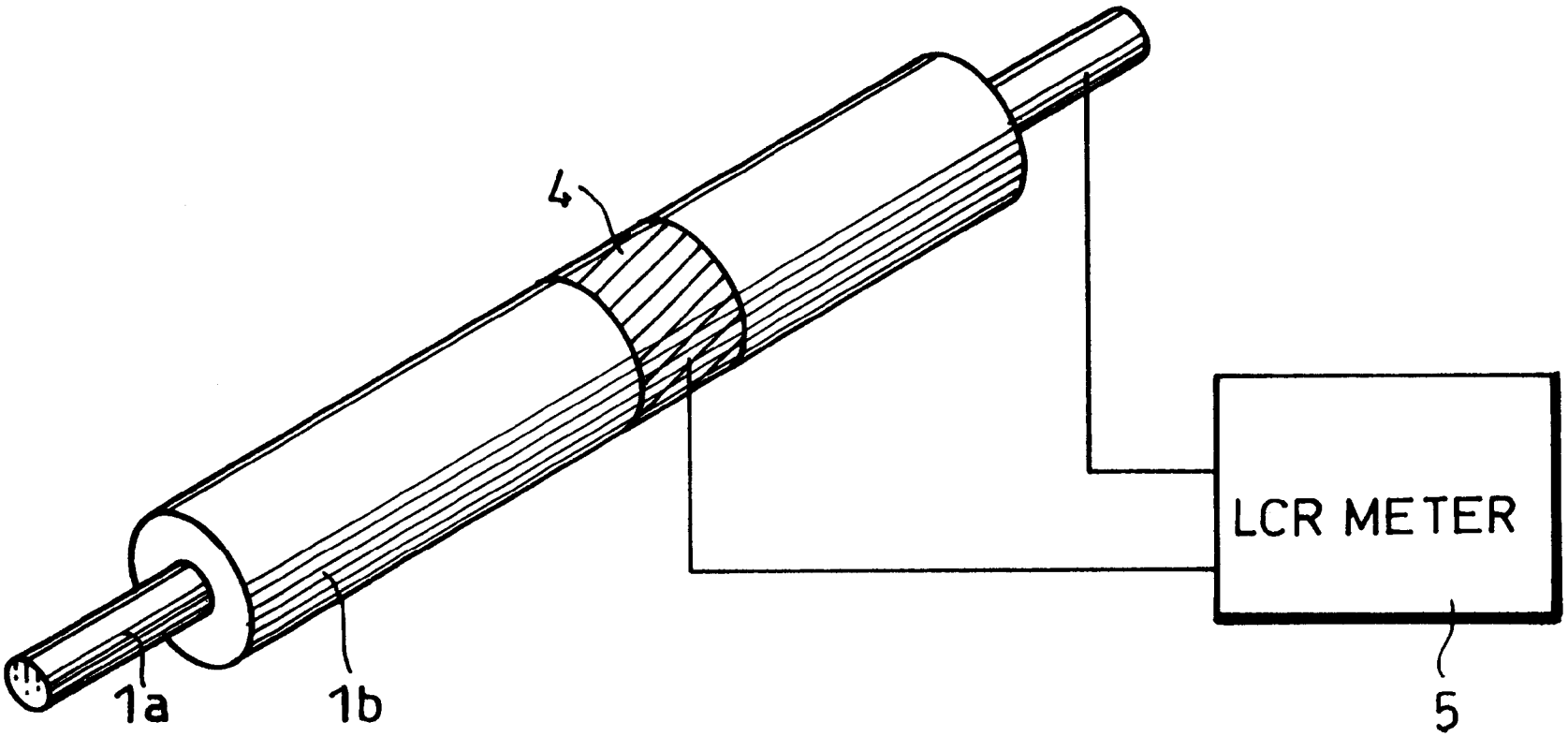
FIG. 3 is an explanatory drawing explaining a method of measuring frequency characteristics of the electrostatic capacity with regard to an elastic member used for a charging roller of the contact charging device of FIG. 1.
Figure 4:
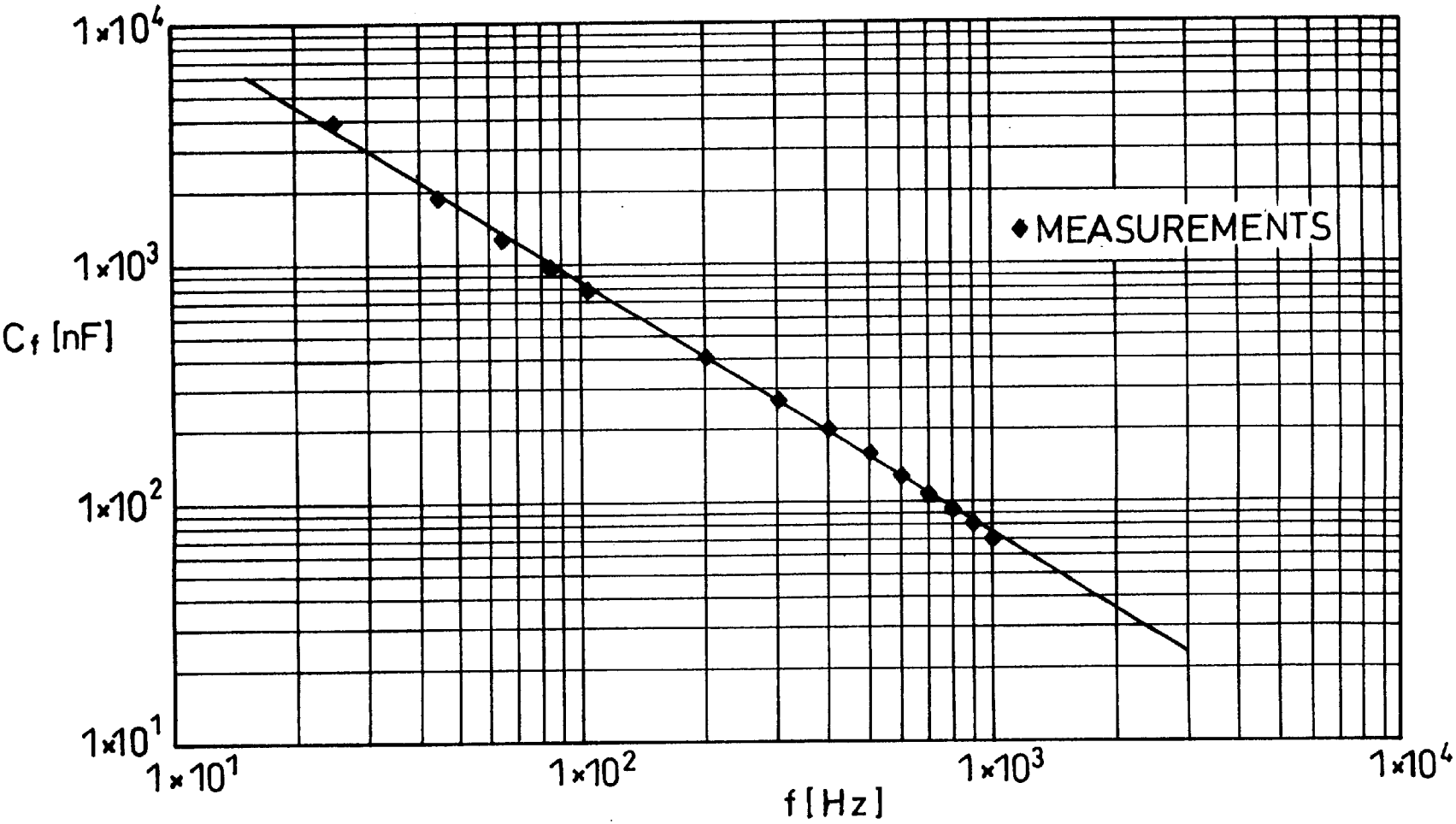
FIG. 4 is a graph showing frequency characteristics of the electrostatic capacity measured by the measuring method of FIG. 3.

Next, as discussed, the following will explain charge characteristics, taking into consideration electrostatic capacity C which is changed when a voltage applied across the combined region of each micro-region of the elastic member 1*b* and the micro-region of the photoconductor 3*b* which is in contact therewith has a frequency component. As shown in FIG. 3, in order to examine change of the electrostatic capacity C with respect to a frequency change in an alternating current (ac) voltage applied to the elastic member 1*b*, an outer surface of the elastic member 1*b* which has a diameter of 27 mm and in which carbon is dispersed was covered with a conductive tape 4, and an LCR meter 5 was connected thereto, then, frequency characteristics of the electrostatic capacity between the core 1*a* and the conductive tape 4 were measured. FIG. 4 shows results of this measurement. It is clear from FIG. 4 that the elastic member 1*b* has a characteristic that the electrostatic capacity attenuates as a frequency of the applied voltage increases.

Here, electrostatic capacity $C_f$ [$F/m^2$] per unit area which is obtained by dividing the electrostatic capacity of the elastic member 1*b* when applying the ac voltage having an arbitrary frequency f [Hz], by the area of the outer surface, can be represented as follows:

$$C_f = C_{1k} \cdot (f/1000)^{-a} \tag{1}$$

using electrostatic capacity $C_{1k}$ [$F/m^2$] per unit area which is obtained in the same way when applying the ac voltage having a frequency of 1 KHz. Note that a is a value which is determined depending on the material of the elastic member 1*b*, and is hereinafter referred to as a rate of change (change rate) a.

Figure 10:
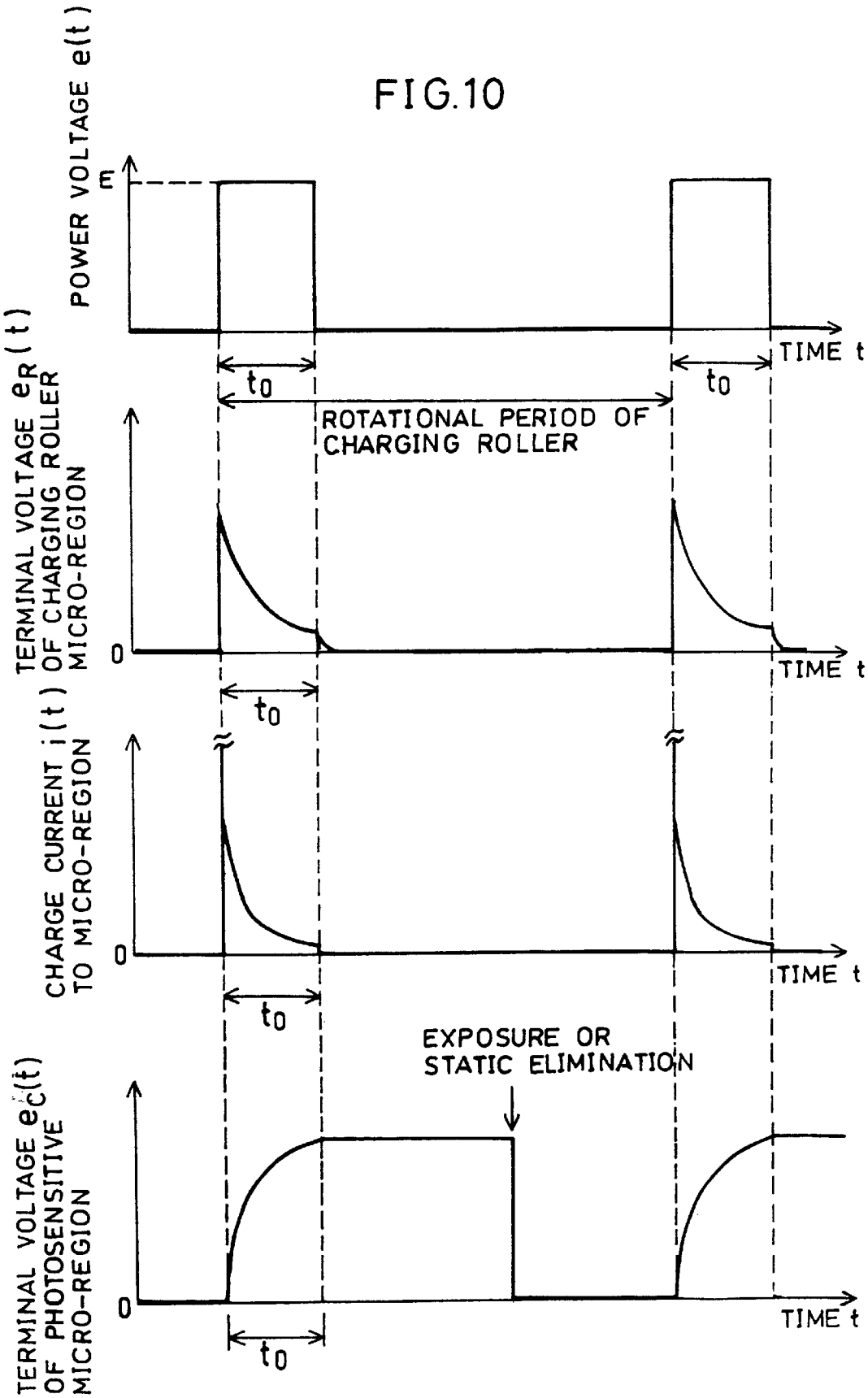
FIG. 10 is a waveform diagram showing a waveform of a voltage or a current of each section in the charging operation by the contact charging device of either FIG. 1 or FIG. 8.

In addition, as shown in FIG. 10 (top), the power voltage e(t) becomes E during a nip portion passing time $t_0$, and is a rectangular pulse having a period of the rotational period T of the charging roller 1. If the rectangular pulse is developed into Fourier series where E=1, the following equation (2) is obtained:

$$e(t) = b_0 + \sum_{n=1}^{\infty} c_n \sin(n\omega t + \theta_n). \tag{2}$$

Here, $b_0$ is a constant, $c_n = (2/n\pi)\sin(n\pi t_0/T)$, $\omega = 2\pi/T$ and $\theta_n = (n\pi t_0)/T$.

Figure 9:
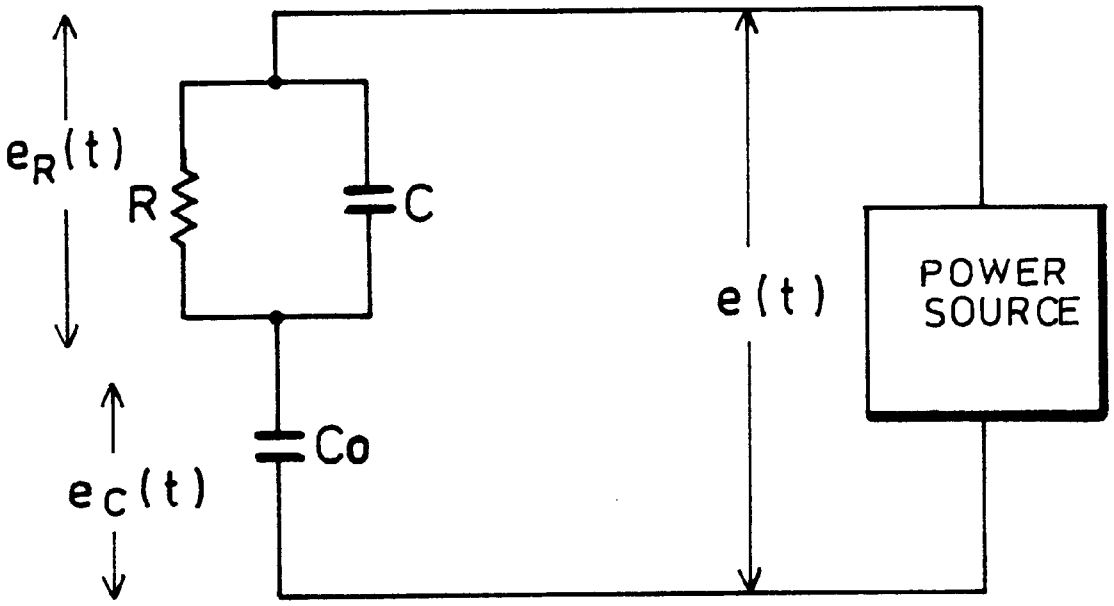
FIG. 9 is a circuit diagram showing an equivalent circuit in a charging operation by the contact charging device of FIG. 8.

Electrostatic capacity $C_{fn}$ with respect to a frequency $f_n = n/T$ in an n-th term of equation (2) is given from equation (1) by $$C_{fn} = C_{1k} \cdot (f_n/1000)^{-a},$$

and therefore, when $\omega_n = 2\pi f_n$ (=nω) the terminal voltage $e_{cn}(t)$ of the electrostatic capacity $C_0$ by an n-th frequency component is given by employing the equivalent circuit shown in FIG. 9, as $$e_{cn}(t) = \{c_n \cdot \sin(n\omega t + \theta_n)\} \times (1/j\omega_n C_0)/\{R \parallel (1/j\omega_n C_{fn}) + (1/j\omega_n C_0)\}.$$

Note that, $R \parallel (1/j\omega_n C_{fn})$ is impedance in a micro-region (parallel circuit made up of the resistance R and the electrostatic capacity $C_{fn}$) of the elastic member 1*b*.

If the terminal voltage $e_{cn}(t)$ is added up to 1000 terms with respect to n, and the terminal voltage $e_c(t)$ of the electrostatic capacity $C_0$ is approximated, it is shown as $$e_c(t) = b_0 + \sum_{n=1}^{1000} e_{cn}(t). \quad (3)$$

Figure 2:
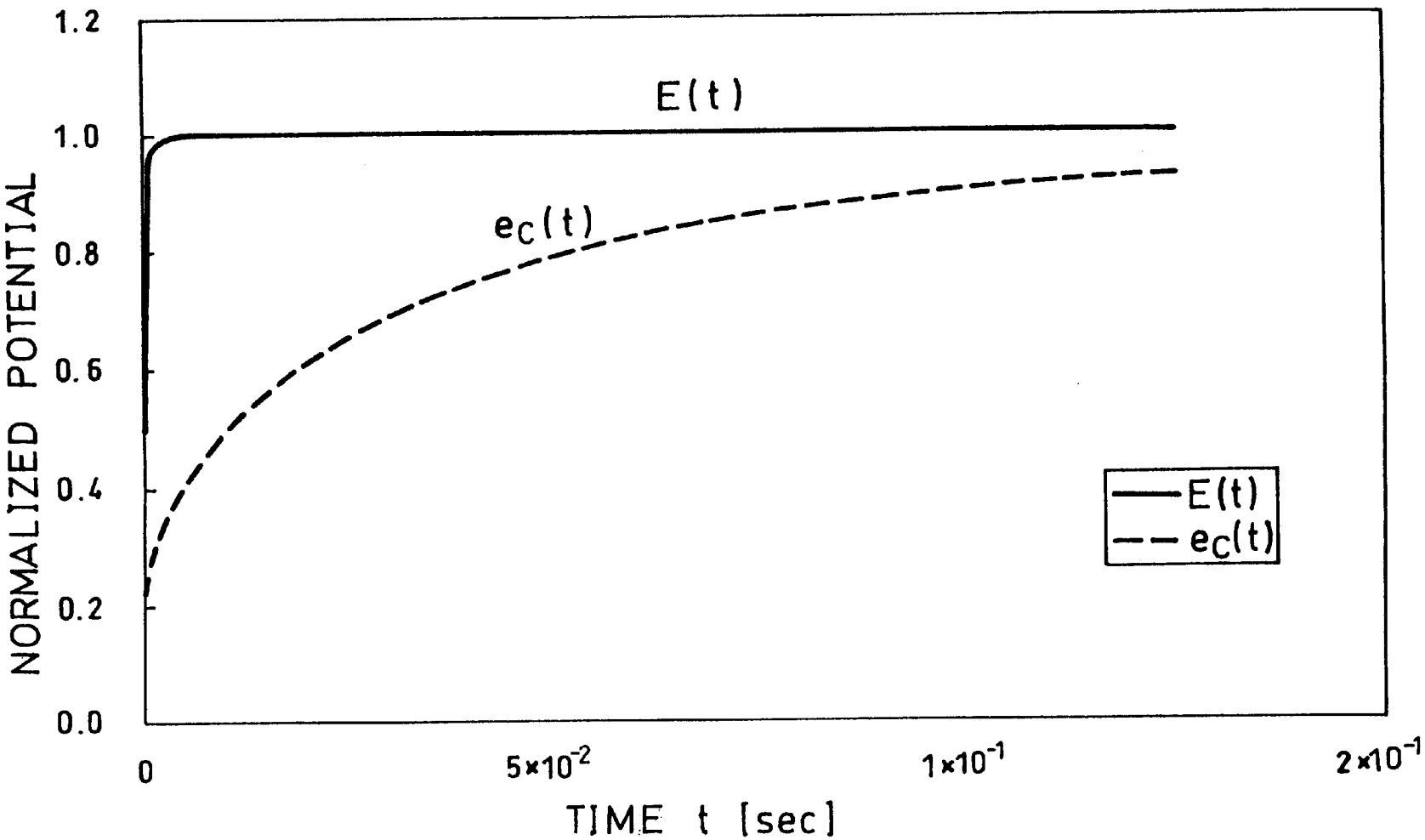
FIG. 2 is a graph showing a step response of a charge potential of a photoconductor in case of not considering frequency characteristics of electrostatic capacity in the contact charging device of FIG. 1.

Note that, $b_0$ is determined in such a way that a terminal voltage $e_c(0)$ becomes a residual voltage of the photoconductor 3*b* immediately before it is charged by the charging roller 1. FIG. 2 shows results of a simulation of a step response of the terminal voltage $e_c(t)$ of the photoconductor 3*b* with respect to a voltage E(t) (maximum value is the dc voltage E) after feeding a voltage from the dc low voltage power source 2 at the time t=0, using equation (3) as obtained above. Note that, the maximum value E of the voltage E(t) is normalized to 1.

The terminal voltage $e_c(t)$ shows a response as illustrated in FIG. 2. A practical process design range includes a process speed of 25 mm/sec–500 mm/sec, a nip width of 5 mm–50 mm, and the nip portion passing time $t_0$ of 0.1 sec–0.2 sec for each micro-region of the photoconductor 3*b*. Therefore, in order to attain stable charging in which the terminal voltage $e_c(t)$ rises to reach 90% or more of a saturation value at the time the micro-region has passed the nip portion, it is preferable that $t_0/\tau \geqq 2.3$ where $\tau$[sec] is the time constant of charging the electrostatic capacity $C_0$. Thus, in the present embodiment, the electrostatic capacity C is substituted with the electrostatic capacity $C_f$ per frequency component, and the terminal voltage $e_c(t)$ of the electrostatic capacity $C_0$, i.e. the charge voltage, is obtained by synthesizing the terminal voltage $e_{cn}(t)$ as determined by using each electrostatic capacity $C_f$.

Figure 5:
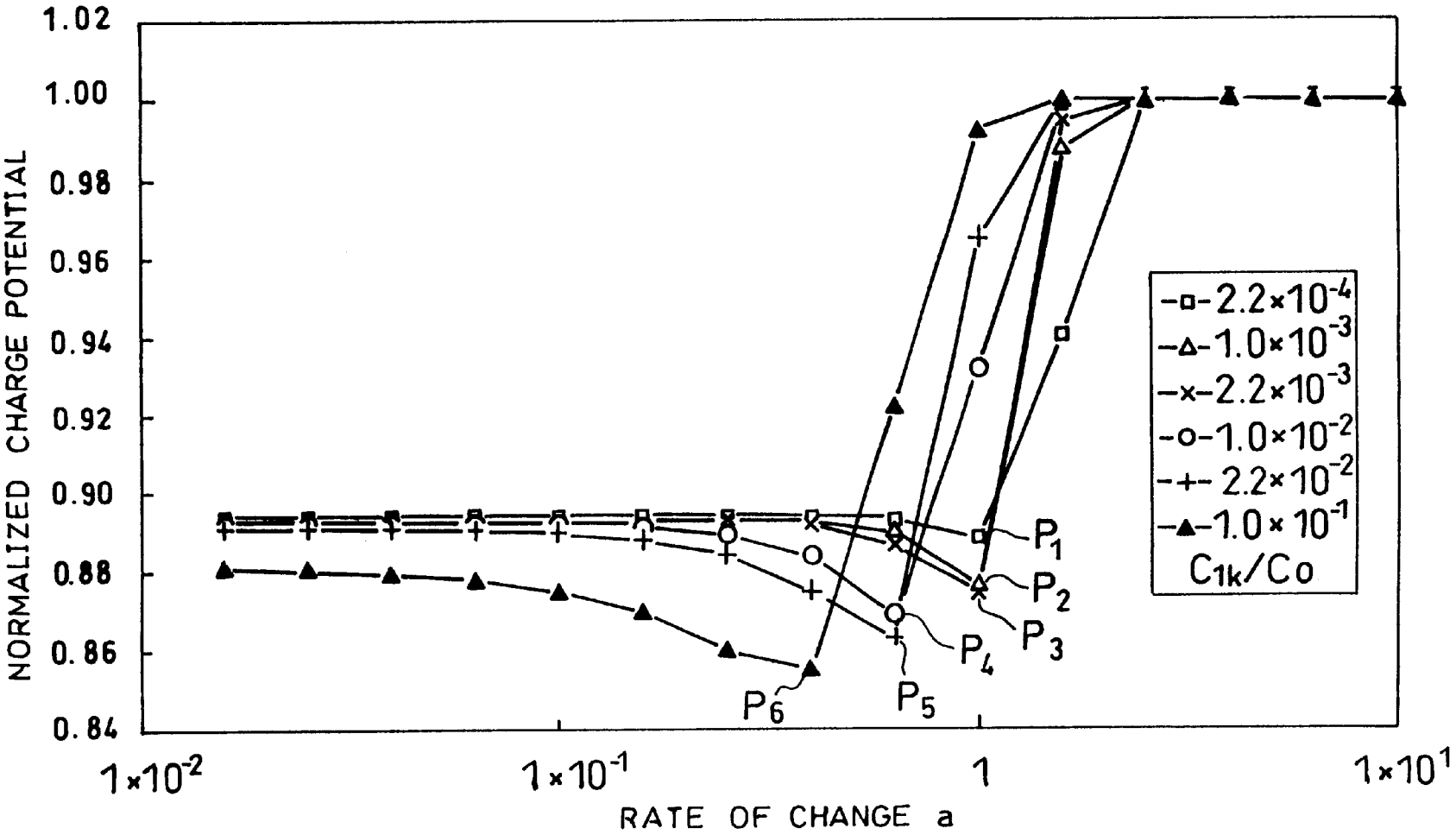
FIG. 5 is a graph showing a relationship between a rate of change a and the charge potential of the photoconductor after passing a nip portion, which was calculated based on the graph of FIG. 4.

Further, a graph shown in FIG. 5 is obtained from an examination of a relationship between the change rate a and the charge potential of the photoconductor 3*b* after passing the nip portion, using equation (3) and $C_{1k}/C_0$ as a parameter. The maximum value of the charge potential is normalized to 1. Note that, here, a film thickness of the photoconductor 3*b* is 20 $\mu$m, a relative dielectric constant of the photoconductor 3*b* is 3, resistance R per unit area of the elastic member 1*b* is $2.57\times10^4$ $\Omega m^2$, and time constant $\tau$ of charging when not considering the electrostatic capacity C of the elastic member 1*b* is $C_0 \cdot R = 0.03347$ sec.

As is clear from FIG. 5, the charge potential shows stable values when the change rate a is relatively small while the charge potential varies drastically when the change rate a exceeds a certain value. Thus, where the charge potential varies to a large extent, i.e. in an area on the right side of inflection points $P_1$ through $P_6$ in FIG. 5, stable charging is difficult due to variation or fluctuation of the change rate a, which may result in nonuniformity of charge. Thus, it is evident that the change rate a of the elastic member 1*b* should be smaller than the inflection points $P_1$ through $P_6$ so as to attain stable charging. For example, as shown in FIG. 5, in a range where the change rate a is 0.1 or less, when $C_{1k}/C_0 = 2.2\times10^{-4}$, $1.0\times10^{-3}$, $2.2\times10^{-3}$, $1.0\times10^{-2}$ or $2.2\times10^{-2}$, the fluctuation in the charge potential is nearly zero, and even when $C_{1k}/C_0 = 1.0\times10^{-1}$, the fluctuation in the charge potential remains at around 1%.

Figure 6:
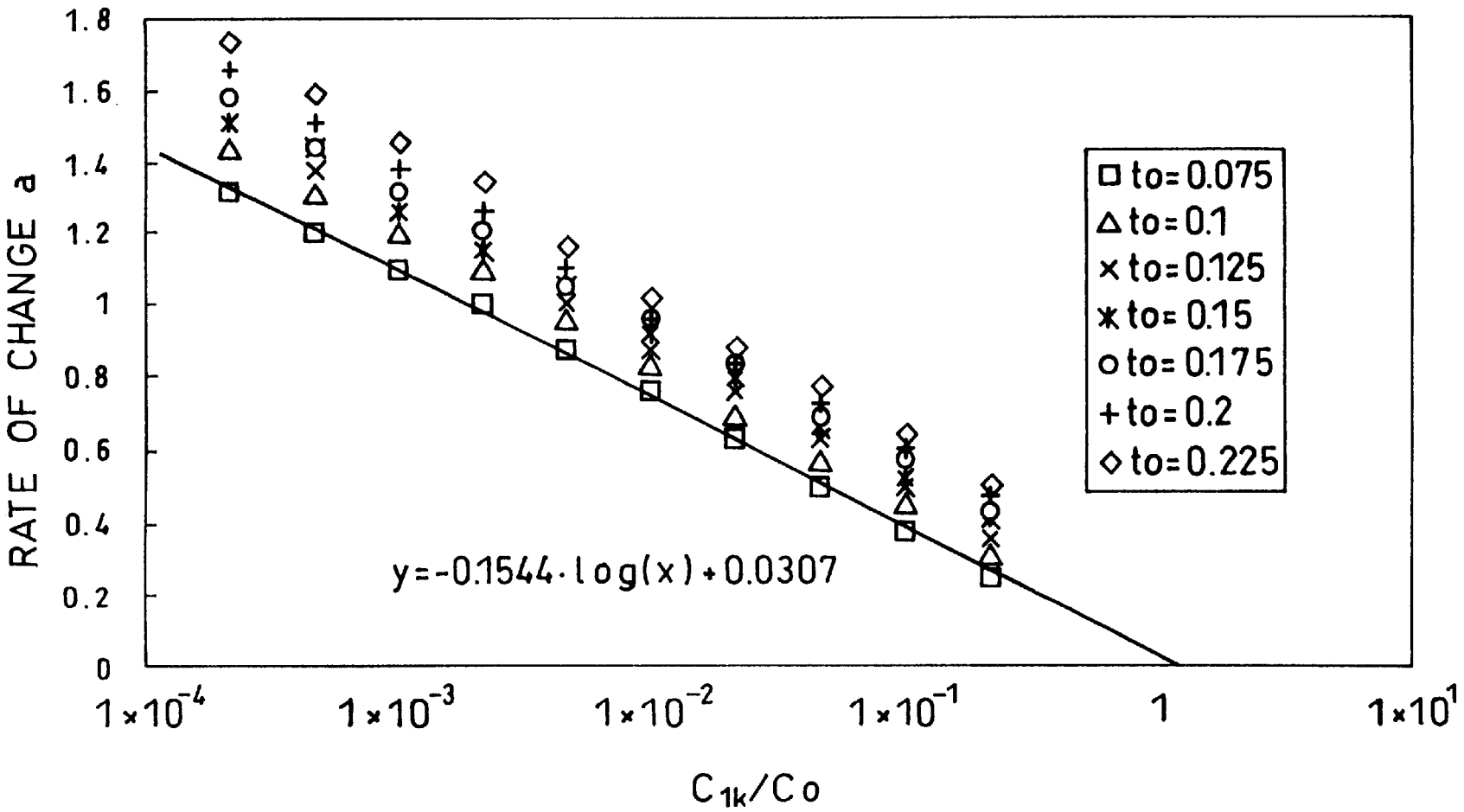
FIG. 6 is a graph showing a relationship between the electrostatic capacity of the elastic member and a rate of change a at an inflection point, which was calculated based on the graph of FIG. 5.

Here, FIG. 6 shows a graph obtained by plotting a relationship between $C_{1k}/C_0$ and the change rate a, using the nip portion passing time $t_0$ as a parameter in order to find a condition which generally gives the change rate a a value at or less than the inflection point. In this case, the nip portion passing time $t_0$ was chosen from a range of 0.075 sec–0.225 sec in a 0.025 sec step. This range is $2.24 \leqq t_0/\tau \leqq 6.72$. Namely, this is a condition for the charge potential of the photoconductor 3*b* to rise to 90%–99.8% of the saturation value by passing the nip portion, and it is effective as well even when the photoconductor 3*b* and/or the elastic member 1*b* is different and when the process speed is changed.

An approximate line of each plot at $t_0$=0.075 sec, where the change rate a becomes minimum in FIG. 6, is represented by $$y = -0.1544 \cdot \log(x) + 0.0307.$$

Therefore, a condition which gives the change rate a a value at or less than the inflection point regardless of the nip portion passing time $t_0$ within the foregoing range is given by $$a \leqq -0.1544 \cdot \log(C_{1k}/C_0) + 0.0307. \quad (4)$$

Note that, when the change rate a fluctuates depending on a value of f, the maximum value is employed.

Figure 7:
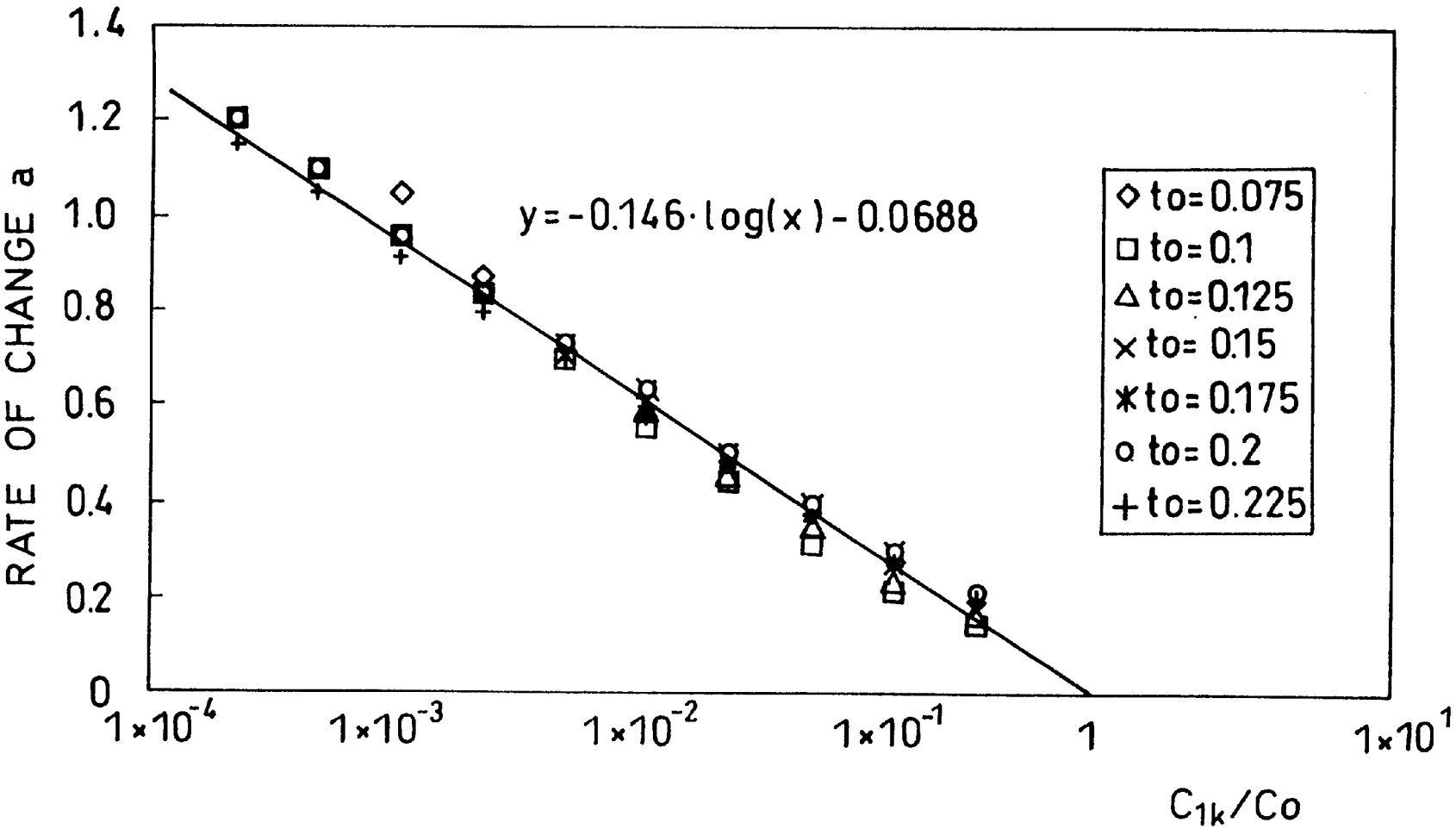
FIG. 7 is a graph showing a relationship between the electrostatic capacity of the elastic member and a rate of change a which gives a fluctuation range of the charge potential of 2% which was calculated based on the graph of FIG. 5.
Figure 8:
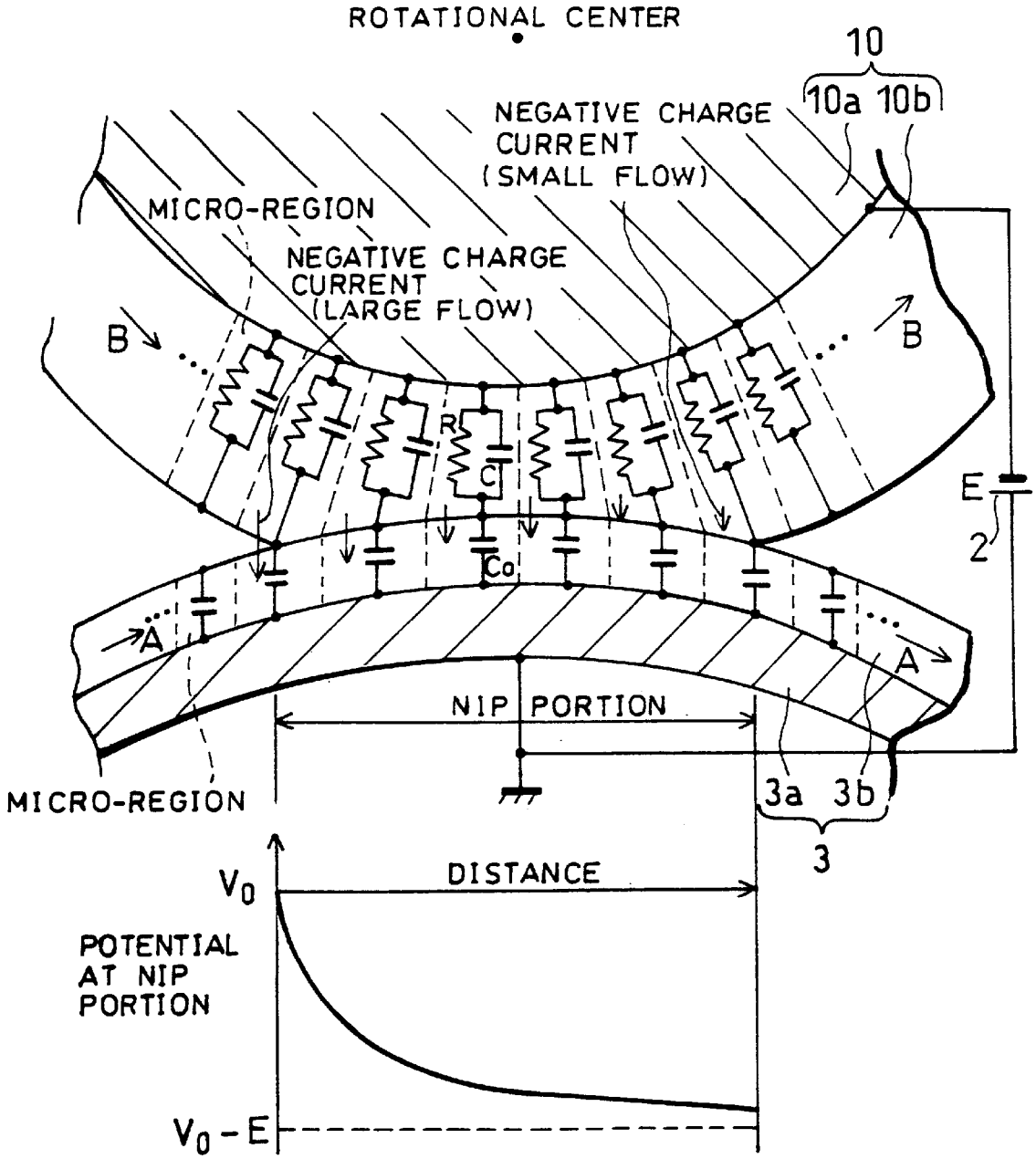
FIG. 8 is an explanatory drawing explaining a structure of a conventional contact charging device and a charging operation thereby.

Meanwhile, when putting the charging roller 1 to a practical use, it is preferable to consider the variation and the fluctuation in the change rate a, as discussed. For example, in the case of a photocopier, when the charge potential of the photoconductor 3*b* is 500 V, a ratio of photographic density/potential is 1/200 V and an acceptable density fluctuation with respect to a half tone is 0.025, an acceptable half-tone potential fluctuation becomes 5 V while an acceptable charge potential fluctuation becomes 10 V. Consequently, the acceptable charge potential fluctuation becomes 2%, and it is practical to adopt a change rate a of a range in which an acceptable value of fluctuation in the normalized potential shown in FIG. 5 is 2%. FIG. 7 shows a graph obtained to determine such a range of the change rate a, by plotting a relationship between $C_{1k}/C_0$ and a limit of the change rate a in which the fluctuation in the normalized potential becomes 2%, using the nip portion passing time $t_0$ as a parameter as in FIG. 6.

As shown in FIG. 7, the limits of the change rate a do not depend on the nip portion passing time $t_0$ and the values lie almost on a single line, and this approximate line is represented as $$y = -0.146 \cdot \log(x) - 0.0688.$$

Consequently, a practical range of the change rate a in which the acceptable charge potential fluctuation becomes 2% is given as $$a \leqq -0.146 \cdot \log(C_{1k}/C_0) - 0.0688. \quad (5)$$

Note that, since the maximum value of the change rate a is adopted here again when the change rate a varies in accordance with the frequency component, the ranges of the change rate a obtained from equations (4) and (5) are a condition by which the charge potential of the photoconductor 3*b* more surely falls in a stable region and in turn in a practical region.

As discussed, in the contact charging device of the present embodiment, the charge uniformity of the photoconductor 3*b* can be improved by appropriately setting a ratio of the nip portion passing time $t_0$ to the time constant $\tau$ of charging within the foregoing range, and by making up the elastic member 1*b* using a material which makes the change rate a as specified by equation (1) to fall within the range of equation (4) or equation (5).

In other words, the contact charging device of the present embodiment includes the elastic member 1*b* for charging the surface of the photoconductor 3*b* to a predetermined potential, the elastic member 1*b* being made of a material which satisfies a certain condition. The condition is set based on a charge potential of the photoconductor 3*b*, and the charge potential is obtained from the electrostatic capacity of the elastic member 1*b*, where the electrostatic capacity is a variable which varies in accordance with frequency change of a voltage applied to the elastic member 1*b*.

In addition, the electrostatic capacity of the elastic member 1*b* is a variable which varies in accordance with frequency change of the voltage and with the change rate a which is determined by the material of the elastic member. Moreover, the condition is such that the fluctuation in the charge potential of the photoconductor 3*b* which is based on variation in value of the change rate a falls within a predetermined range in which nonuniformity of charge does not occur in the photoconductor 3*b*.

A material having such a small change rate a includes, for example, polyester resin and styrene resin, both of which can suitably be used as the elastic member 1*b*.

Further, although the foregoing explanation was given through the case where the charging roller 1 which is made up of a single layer used as the elastic member 1*b*, the present invention can also be applied to a charging roller with the elastic member 1*b* having a multi-layered structure. In that case, the change rate a is optimized for each layer by determining electrostatic capacity $C_f$ which corresponds to the frequency component of the applied voltage.

In addition, though the dc low voltage power source 2 was used as the power source, an ac superimposed power source can be used instead. In that case, a voltage in which the ac component is superimposed on the dc component is applied between the core 1*a* of the charging roller 1 and the drum body 3*a* of the photoconductor 3*b* by the ac superimposed power source. Hence, a voltage applied across a combined region of each micro-region of the elastic member 1*b* and the micro-region of the photoconductor 3*b* in contact therewith becomes a voltage in which the ac component is added to the rectangular pulse generated from the dc component. Consequently, the range of the change rate a is specified as above, considering the change rate a with a frequency component making up the rectangular pulse, together with the frequency component of the ac component. As a result, not only the characteristics when the dc voltage is applied are carried over, but also the condition of the change rate a having an addition of the ac component, which has conventionally been considered to contribute to improvement of the charge uniformity of the photoconductor, is obtained, thereby enhancing possibility of further improvement of the charge uniformity.

As discussed, the contact charging device of the present invention includes a charging member which rotates while being in contact with a surface of a photoconductor which is rotatably driven, and a power source for applying a voltage between a surface of the photoconductor on the side of a rotational center and a surface of the charging member on the side of the rotational center, and the contact charging device may have an arrangement in which, when $$C_f = C_{1k} \cdot (f/1000)^{-a}$$

is given by using the change rate a which is determined by a material of the charging member, where $C_f$ and $C_{1k}$ are electrostatic capacities obtained by dividing electrostatic capacity of the charging member by an area of its outer surface when an arbitrary frequency f [Hz] and an ac voltage of 1 kHz are applied between the surface on the side of the rotational center and the outer surface, respectively, the material of the charging member is selected so that fluctuation in a charge potential of the photoconductor falls within a predetermined range with respect to fluctuation within a predetermined range of the change rate a.

In the charging member which rotates while in contact with the photoconductor, considering the micro-regions which are generated by being divided by infinite numbers of division lines in a radial direction linking the rotational center and the outer surface and whose resistance and electrostatic capacity are equivalent to each other, the photoconductor is supplied with charge whenever each micro-region passes through the contact portion since a voltage is applied between the photoconductor on the side of the rotational center and the charging member on the side of the rotational center. Accordingly, a charging operation for charging each micro-region of the photoconductor which contacts the surface of each micro-region of the charging member becomes repetition of intermittent application of a voltage. Therefore, a voltage applied across a combined region of each micro-region of the charging member and the micro-region of the photoconductor which are in contact with each other rises only while they are in contact, and the voltage becomes a pulse waveform whose period is the rotational period of the charging member. Consequently, the voltage applied to each micro-region of the charging member includes a frequency component even when the power source is the dc power source, and the electrostatic capacity of each micro-region of the charging member varies in accordance with a frequency.

In the foregoing invention, when the electrostatic capacity $C_f$ per unit area, which is obtained by dividing the electrostatic capacity of the charging member by the area of the outer surface when the ac voltage of the frequency f is applied, is represented by the above equation using the electrostatic capacity $C_{1k}$ per unit area when the ac voltage of 1 kHz is applied, and the change rate a which is determined by a material of the charging member, the electrostatic capacity of each micro-region of the charging member per unit area is substituted with the electrostatic capacity $C_f$ per each frequency component of the pulse. Further, the charge potential of the photoconductor is used as the synthesized terminal voltage applied by each frequency component to the photoconductor through the electrostatic capacity $C_f$.

As a result, it is confirmed that the charge potential of the photoconductor depends on the change rate a, and there exists a range of the change rate a that makes the charge potential unstable with respect to fluctuation of the change rate a. Hence, in order to prevent the change rate a from falling in this unstable region, the charging member is composed by selecting a material having such a change rate a that fluctuation of the charge potential of the photoconductor falls within a predetermined range with respect to fluctuation within the predetermined range, thereby improving charge uniformity.

As discussed, charge uniformity of the photoconductor can be sufficiently improved by composing the charging member with a material which satisfies a condition for stable charging, which is obtained by taking frequency characteristics of the electrostatic capacity into consideration.

Further, in order to solve the foregoing problems, the contact charging device of the present invention may have an arrangement in which when $$2.24 \leqq t_0/\tau \leqq 6.72$$

holds, where $t_0$ is time required for the photoconductor to pass through a contact portion between the charging member and the photoconductor, and $\tau$ is a time constant of charging the photoconductor, a material of the charging member is selected to satisfy $$a \leqq -0.1544 \cdot \log (C_{1k}/C_0) + 0.0307,$$

where $C_0$ is electrostatic capacity of the photoconductor per unit area.

In the foregoing invention, the charge potential after the photoconductor has passed the contact portion between the charging member and the photoconductor is determined by the passing time $t_0$ and the time constant $\tau$ of charging, and $t_0/\tau$ is set within the foregoing range so as to obtain a desired charge potential, which is 90%–99.8% of the saturation value. In this case, using as a border the value on the right-hand side of the above equation where the electrostatic capacity $C_{1k}$ and the electrostatic capacity $C_0$ of the photoconductor per unit area are used, it is confirmed that the charge potential becomes unstable in a region where a value of the change rate a becomes larger than the border value, while the charge potential becomes stable in a region where the value of the change rate a becomes not more than the border value. Consequently, charge uniformity can be improved at a desired charge potential by composing the charging member with a material having the change rate a which falls within a range in which the charge potential is in the stable region.

Further, the contact charging device of the present invention may have an arrangement in which a material of the charging member is selected to satisfy $$a \leqq -0.146 \cdot \log(C_{1k}/C_0) - 0.0688.$$

For a practical use, it is preferable, under the condition where the charge potential of the photoconductor becomes 90%–99.8% of the saturation value, that fluctuation of the charge potential is suppressed to not more than 2% with respect to variation or fluctuation of the change rate a. In the foregoing invention, fluctuation of the charge potential becomes 2% when the change rate a takes the value on the right-hand side of the above equation where the electrostatic capacity $C_{1k}$ and the electrostatic capacity $C_0$ are employed, while fluctuation of the charge potential becomes smaller when the change rate a is less than the value on the right-hand side of the equation. Consequently, fluctuation of the charge potential is further suppressed within the range of the change rate a in the foregoing invention by composing the charging member with a material having the change rate a which falls within the foregoing range, thereby attaining a condition which realizes efficient charging.

Further, the contact charging device of the present invention may have an arrangement in which the power source is the dc power source.

In the foregoing invention, a voltage applied across a combined region of the micro-region of the charging member and the micro-region of the photoconductor which are in contact with each other takes a constant value by the dc voltage only while they are in contact, and the voltage becomes equivalent to a rectangular pulse whose period is the rotational period of the charging member. Thus, considering the change rate a by obtaining a frequency component which composes this rectangular pulse, the range of the change rate a is specified in accordance with the foregoing invention. Accordingly, charge uniformity can sufficiently be improved with respect to the dc power source that has conventionally been believed to fall behind an ac superimposed power source in terms of charge uniformity of a photoconductor.

Further, the contact charging device of the present invention may have an arrangement in which the power source is the ac superimposed power source.

In the foregoing invention, since the ac superimposed power source applies a voltage, in which the ac voltage is superimposed on the dc voltage, between the charging member and the photoconductor, a voltage applied across a combined region of the micro-region of the charging member and the micro-region of the photoconductor which are in contact with each other becomes equivalent to a voltage in which an ac component is added to a rectangular pulse made from a dc component. Accordingly, the range of the change rate a is specified in accordance with the foregoing invention by considering the change rate a with the frequency component which composes the rectangular pulse, together with a frequency component of the ac component. Consequently, the characteristics when the dc voltage is applied are carried over, and moreover, the condition of a with the addition of the ac component, that has conventionally been believed to contribute to improvement in charge uniformity of the photoconductor is obtained, thereby increasing possibility of further improving charge uniformity.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A contact charging device which includes a charging member for charging a surface of a photoconductor to a predetermined potential, said charging member being made of a material which satisfies a condition being set based on a charge potential of said photoconductor, said charge potential being obtained from electrostatic capacity of said charging member being a variable which varies in accordance with a frequency change of a voltage applied to said charging member.

2. The contact charging device as set forth in claim 1, wherein:

the electrostatic capacity of said charging member is a variable which varies in accordance with the frequency change of said voltage and with a rate of change a which is determined by the material of said charging member, and said condition is such that fluctuation in the charge potential of said photoconductor which is based on variation in value of said rate of change a falls within a predetermined range in which nonuniformity of charge is prevented in said photoconductor.

3. The contact charging device as set forth in claim 2, wherein:

a fluctuation range of the charge potential of said photoconductor which is based on variation in value of the rate of change a changes over a threshold value of the rate of change a, and said condition is such that the rate of change a of said charging member is smaller than said threshold value.

4. The contact charging device as set forth in claim 3, wherein:

when $C_f$ and $C_{1k}$ are electrostatic capacities per unit area obtained by dividing electrostatic capacities of said charging member by an area of its outer surface when ac voltages of an arbitrary frequency f [Hz] and 1 kHz are applied between a surface of said charging member on a side of a rotational center and said outer surface, respectively, $$C_f = C_{1k} \cdot (f/1000)^{-a}$$

is satisfied, and when $C_0$ is electrostatic capacity of said photoconductor per unit area, said condition is such that said rate of change a satisfies $$a \leqq -0.1544 \cdot \log(C_{1k}/C_0) + 0.0307.$$

5. The contact charging device as set forth in claim 4, wherein:

said condition is such that said rate of change a satisfies $$a \leqq -0.146 \cdot \log(C_{1k}/C_0) - 0.0688.$$

6. The contact charging device as set forth in claim 1, wherein:

when $t_0$ is time required for said photoconductor to pass through a contact portion between said charging member and said photoconductor, and $\tau$ is a time constant of charging said photoconductor, a relation of $$2.24 \leqq t_0/\tau \leqq 6.72$$

is satisfied.

7. The contact charging device as set forth in claim 1, further comprising:

a dc power source for applying a voltage between a surface of said photoconductor on a side of a rotational center and a surface of said charging member on a side of a rotational center.

8. The contact charging device as set forth in claim 1, further comprising:

an ac superimposed power source for applying a voltage between a surface of said photoconductor on a side of a rotational center and a surface of said charging member on a side of a rotational center.

9. A contact charging device which includes a charging member which rotates while being in contact with a surface of a photoconductor which is rotatably driven, and a power source for applying a voltage between a surface of said photoconductor on a side of a rotational center and a surface of said charging member on a side of a rotational center, wherein, when $$C_f = C_{1k} \cdot (f/1000)^{-a}$$

is given by using a rate of change a which is determined by a material of said charging member, where $C_f$ and $C_{1k}$ are electrostatic capacities per unit area obtained by dividing electrostatic capacity of said charging member by an area of its outer surface when ac voltages of an arbitrary frequency f [Hz] and 1 kHz are applied between the surface of said charging member on the side of the rotational center and said outer surface, respectively, the material of said charging member is selected so that fluctuation in a charge potential of said photoconductor falls within a predetermined range with respect to fluctuation within a predetermined range of the rate of change a.

10. The contact charging device as set forth in claim 9, wherein:

when $$2.24 \leqq t_0/\tau \leqq 6.72$$

holds, where $t_0$ is time required for said photoconductor to pass through a contact portion between said charging member and said photoconductor, and $\tau$ is a time constant of charging said photoconductor, the material of said charging member is selected to satisfy $$a \leqq -0.1544 \cdot \log(C_{1k}/C_0) + 0.0307,$$

where $C_0$ is electrostatic capacity of said photoconductor per unit area.

11. The contact charging device as set forth in claim 10, wherein:

the material of said charging member is selected to satisfy $$a \leqq -0.146 \cdot \log(C_{1k}/C_0) - 0.0688.$$

12. The contact charging device as set forth in claim 9, wherein:

said power source is a dc power source.

13. The contact charging device as set forth in claim 9, wherein:

said power source is an ac superimposed power source.

* * * * *